United States Patent [19]

Kratt et al.

[11] Patent Number: 4,494,517

[45] Date of Patent: Jan. 22, 1985

[54] METHOD AND APPARATUS FOR CONTROLLING AT LEAST ONE THROTTLE CROSS SECTION IN A CONTROL LINE

[75] Inventors: Alfred Kratt, Trossingen; Cornelius Peter, Stuttgart; Claus Ruppmann, Schwieberdingen; Rainer Schillinger, Stuttgart, all of Fed. Rep. of Germany

[73] Assignee: Robert Bosch GmbH, Stuttgart, Fed. Rep. of Germany

[21] Appl. No.: 506,937

[22] Filed: Jun. 22, 1983

[30] Foreign Application Priority Data

Sep. 17, 1982 [DE] Fed. Rep. of Germany ..... 3234468

[51] Int. Cl.[3] ..... F02M 23/04

[52] U.S. Cl. ..... 123/585; 123/339; 251/133

[58] Field of Search ..... 123/339, 585–589; 251/133, 309, 311, 312, 319–323, 325

[56] References Cited

U.S. PATENT DOCUMENTS 3,347,516 10/1967 Linde ..... 251/309
3,475,003 10/1969 Paluszek ..... 251/309
4,356,837 11/1982 Dickinson ..... 251/319
4,412,517 11/1983 Kobashi et al. ..... 251/133
4,426,988 1/1984 Greiner et al. ..... 123/585
4,428,356 1/1984 Kemmner ..... 123/585

*Primary Examiner*—William A. Cuchlinski, Jr.
*Attorney, Agent, or Firm*—Edwin E. Greigg

[57] ABSTRACT

A method and an apparatus for controlling at least one throttle cross section in a control line, in particular in a line carrying operating medium for an internal combustion engine, such as an air bypass around the throttle valve of the engine. The apparatus includes an electric control motor, by means of which a throttle device having a circular-segmental control section can be rotated. The control section is rotatable in a control opening intersecting the control line, and the control line and control opening are connected with one another by a throttle opening which has limiting faces. When the control motor is not excited or if the control motor should fail, the control section is rotated by a spring element against a stop, into a position in which a control edge together with the limiting face opens a first throttle cross section, which is sufficiently large to supply the engine with a sufficient quantity of air for the prevailing situation.

14 Claims, 9 Drawing Figures

METHOD AND APPARATUS FOR CONTROLLING AT LEAST ONE THROTTLE CROSS SECTION IN A CONTROL LINE

BACKGROUND OF THE INVENTION

The invention is based on a method and apparatus for controlling at least one throttle cross section in a control line. Such apparatuses are already known (German Offenlegungsschriften Nos. 28 12 1292, 30 01 471, and 30 19 167), which however have the disadvantage that should the supply of electric current to the control motor fail or, if the apparatus is used in a motor vehicle, upon the shutoff of the internal combustion engine, the throttle device controlling the cross section of the control line will remain stuck in the open position as previously directed by the control motor, or else the throttle device is displaced into a completely closed or completely opened position, which can cause problems either in starting or during continued operation of the engine. An apparatus has therefore already been proposed, in which, upon the interruption of the supply of electric current to the control motor, the throttle device is movable by means of a spring element into a predetermined position which opens the throttle cross section of the control line.

However, such an apparatus requires very precise adjustment of the spring element, and there is an inherent danger that during continuous operation, changes in the fastening of the spring element or in the tension of the spring element itself may cause an undesirable change in the position of the throttle device while the control motor is in the non-excited state.

OBJECT AND SUMMARY OF THE INVENTION

The method according to the invention for controlling at least one throttle cross section in a control line has the advantage over the prior art that with a non-excited control motor, a precisely definable throttle cross section is opened, which is not subjected to any changes even over long-term operation of the apparatus. The apparatus according to the invention for controlling at least one throttle cross section in a control line has the advantage that it is possible with simple means and at a favorable cost to set a throttle cross section which remains the same when the control motor is not excited.

As a result of the characteristics disclosed, advantageous further developments of and improvements to the method and the apparatus are possible.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
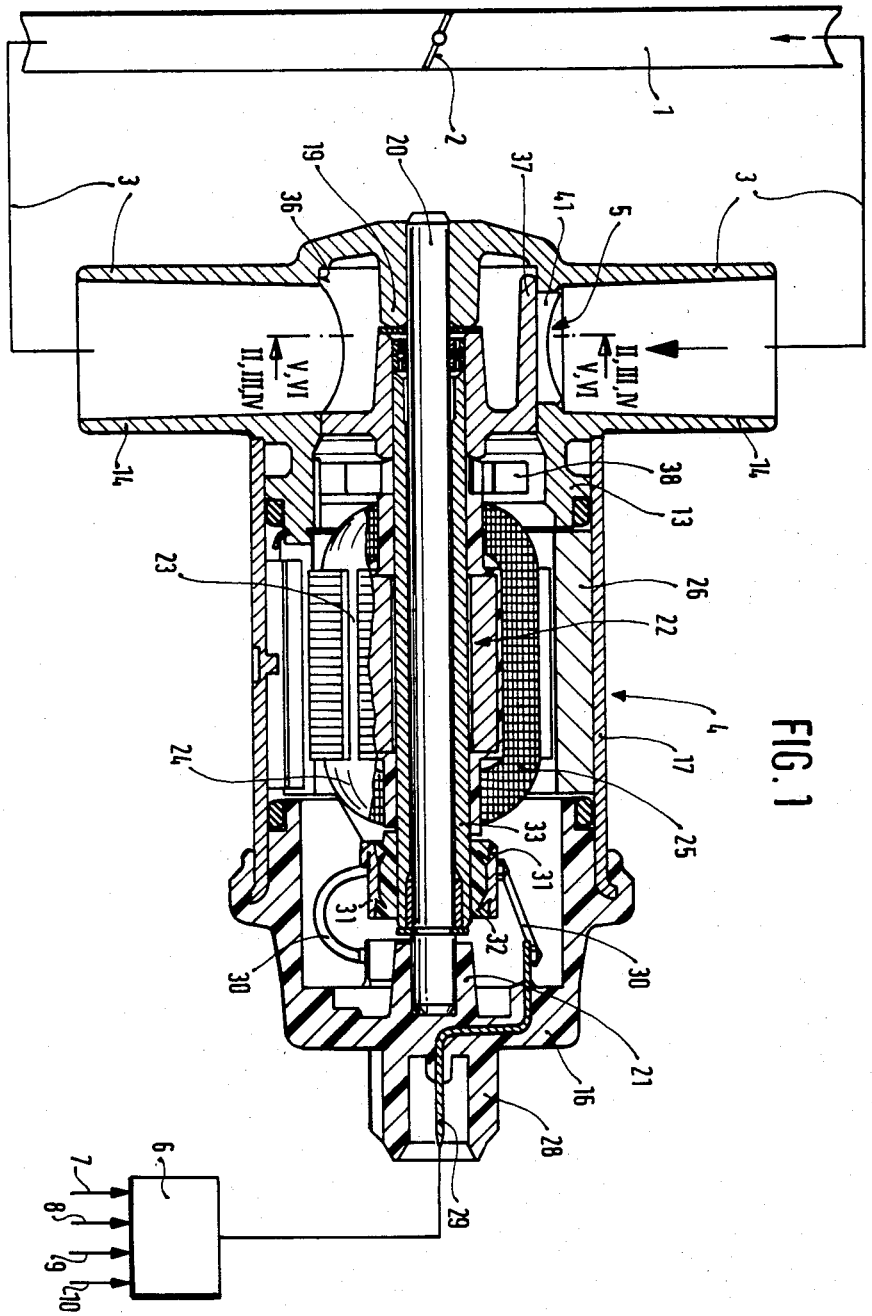
FIG. 1 is a section taken through an apparatus for controlling at least one throttle cross section.

In FIG. 1, air for combustion, for instance, flows in the direction of the arrow through an intake tube 1, past a throttle valve 2, to an internal combustion engine (not shown). Communicating with the intake tube 1 is a bypass line 3 acting as a control line, which leads around the throttle valve 2 and the flowthrough cross section of which is variable by an apparatus 4 by means of a throttle device 5. The apparatus 4 is triggered by an electronic control unit 6, in which the supply voltage is present at 7, the signal picked up by the ignition distributor for the engine rpm is present at 8, the signal for the engine temperature is present at 9 and a voltage characterizing the position of the throttle valve, furnished by way of example by a potentiometer connected with the throttle valve 2, is present at 10.

The apparatus 4 shown by way of example in FIG. 1 is provided with a cap 13, which axially defines the apparatus at one end and is embodied as a cast part including one portion 14 of the bypass line 3. The end of the apparatus 4 remote from the cap 13 is defined by a connecting cap 16. A tubular housing 17 establishes communication between the cap 13 and the connecting cap 16. A fixed shaft 20 is pressed into a protrusion 19 of the portion 14, and at the other end the shaft 20 is supported in a protrusion 21 in the connecting cap 16. An armature 22 of the control motor of the apparatus is rotatably supported on the shaft 20. For generating a reversible 90° rotation, for instance, two windings 24, 25 which are offset from one another by 90° and which act in opposite directions are provided in slots 23 of the armature 22. The two windings 24, 25 are triggered in a known manner by the control unit 6 with current pulses having variable, mutually associated duty cycles, so that the armature 22 assumes a position in the magnetic field formed by two segmental permanent magnets 26 which corresponds to the duty cycle. The electrical connection of the apparatus 4 with the electronic control unit 6 is effected via a flat plug 28 having three plug connections 29. The plug connections 29 are connected by means of stranded wires 30 with contact elements 31 at the circumference of an insulation carrier 32, which is coupled in a rotationally fixed maner with a bearing bushing 33. The bearing bushing 33 is rotatably supported on the shaft 20 and is connected in a rotationally fixed manner with the throttle device 5 and the armature 22.

The contact elements 31 are connected at the other end with the ends of the windings 24, 25. As a result of the clocked triggering of the control motor, the frictional resistances are reduced.

The throttle device 5, embodied as a rotary slide, passes through the cap 13 and the portion 14 and partway into a control opening 36 having a control section 37 in the shape of a circular segment. The control section 37 opens the flowthrough cross section of the bypass line 3 to a greater or lesser extent depending upon the position of the rotary slide 5.

Figure 2:
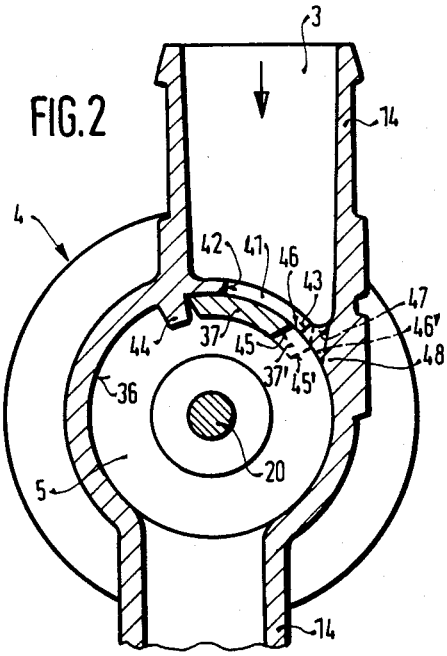
FIG. 2 is a section taken along the line II—II of FIG. 1 showing a position of the throttle device when the control motor is not excited.

A spring element embodied as a spiral spring 38 is also connected with the bearing bushing 33 and is secured attached to the housing at its outer end, for instance on the cap 13. The control line 3 discharges in the flow direction via a throttle opening 41 into the control opening 36 in which the control section 37 is rotatable. The throttle opening 41 is thereby defined in the direction parallel to the shaft 20, or virtually parallel to the shaft 20, on one side by a limiting face 42 and on the other by a limiting face 43, as shown in FIG. 2. The spiral spring 38 is designed such that when the control motor is not excited the throttle device 5 is rotated as shown in FIG. 2 with the control section 37 against a stop 44 attached to the housing so that a first throttle cross section 46 is opened between the limiting face 43 of the throttle opening 41 and a control edge 45, oriented toward it, of the control section 37. This first throttle cross section 46 is sufficient, so that in the event of a failure of the supply of current to the apparatus 4, a favorable fuel-air mixture will be furnished for continued operation of the engine or, upon engine starting, to permit a predetermined, favorable quantity of air to flow to the engine via the control line 3, bypassing the throttle valve 2. In an exemplary embodiment functioning in the same manner, as indicated by dashed lines, the throttle opening 41 is completely closed when the control section 37' rests on the stop 44. In this position, however, the control edge 45' uncovers an opening 47, acting as the first throttle restriction 46', which is formed in the wall 48 between the control line 3 and the control opening 36. The first throttle cross section 46' here is again sufficiently large that during engine starting a predetermined, favorable quantity of air is permitted to flow via the control line to the engine, bypassing the throttle valve 2, or that in the case of an interruption in the supply of current to the control motor caused by a technical defect, a fuel-air mixture which is favorable for the continued operation of the engine is furnished.

Figure 3:
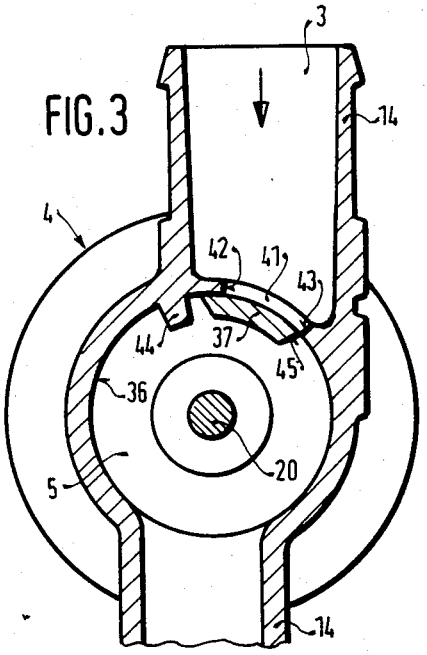
FIG. 3 is a section taken along the line III—III of FIG. 1 showing a throttle device blocking the control line when the control motor is excited.
Figure 4:
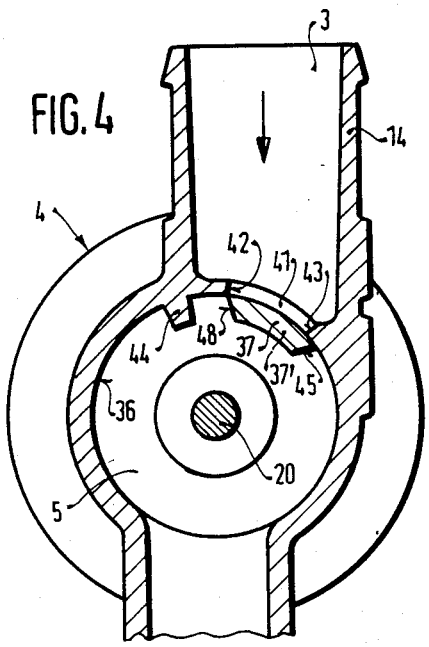
FIG. 4 is a section taken along the line IV—IV of FIG. 1 showing a throttle device in a different position while blocking the control line when the control motor is excited.
Figure 7:
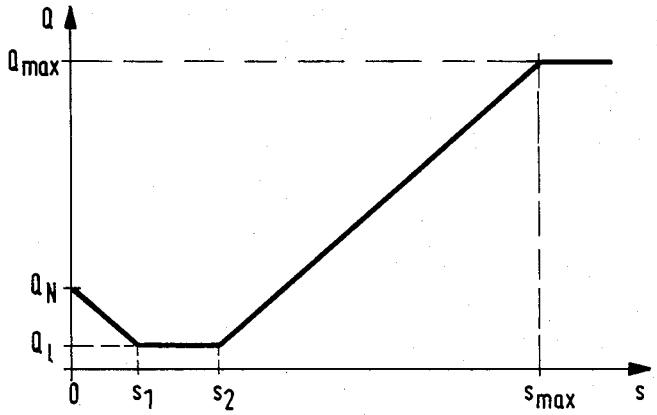
FIG. 7 is a diagram showing the course of the flowthrough quantity A of the operating medium over the adjustment path s of the throttle device.
Figure 8:
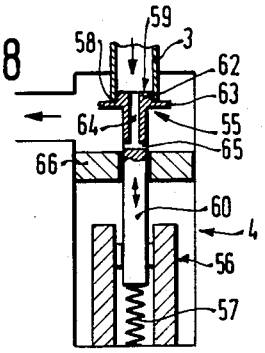
FIG. 8 is a schematic representation of a further apparatus embodied in accordance with the invention, having an axially movable throttle device shown in the closed position.

In FIG. 7, a diagram shows the quantity Q of the operating medium which is to be directed via the control line 3, for instance the air intended for an internal combustion engine, over the adjustment path s of the throttle device 5 or the throttle device 55 of FIG. 8. In the apparatus 4 embodied as shown in FIGS. 1–6, the adjustment path represents an angle. Depending on the position of the control section 37 in which in its position of rest it is in contact with the stop 44, an emergency-operation air quantity having the magnitude $Q_N$ results, flowing via the first throttle cross section 46, 46'. If the control motor is now excited, then the control section 3 rotates clockwise as seen in FIG. 3, until in a position $s_1$ the control edge 45 reaches the limiting face 43 of the throttle opening 41 and the first throttle cross section 46 is closed. The control section 37 now covers the throttle opening 41 completely, and only a leakage air quantity $Q_1$ can now flow via the control line 3, since for reasons of manufacturing tolerances the apparatus 4 cannot be made absolutely tight. The same is true of a control section 37', which in the position $s_1$ blocks the first throttle cross section 46'.

Upon further excitation of the control motor, up to a positon $s_2$, the control section 37, 37' by rotating clockwise attains a position in which a control edge 48, remote from the control edge 45, of the control section 37, 37' comes to coincide with the limiting face 42 of the throttle opening 41. During this intermediate adjustment path or in this intermediate adjustment range between the positions $s_1$ and $s_2$, each throttle cross section thus remains closed, and only the smallest possible leakage quantity $Q_1$ can flow via the control line.

Figure 5:
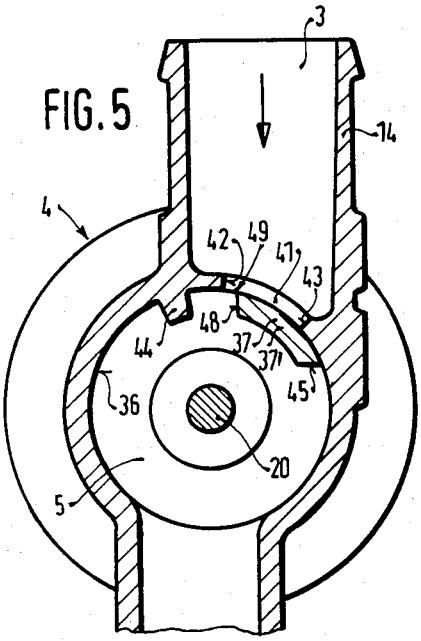
FIG. 5 is a section taken along the line V—V of FIG. 1 showing a throttle device partially opening a throttle cross section when the control motor is excited.
Figure 6:
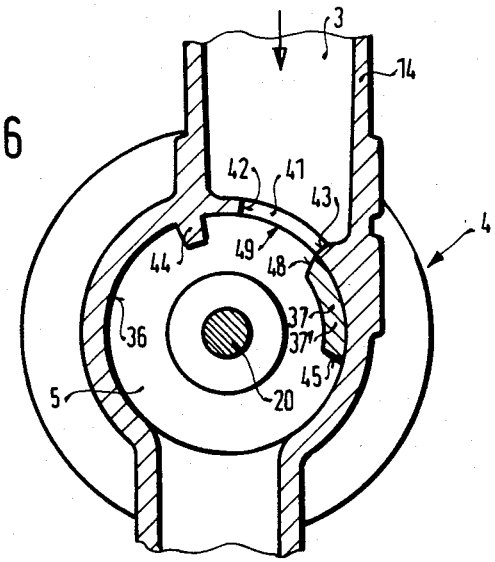
FIG. 6 is a section taken along the line VI—VI of FIG. 1 showing a throttle device opening the throttle cross section completely when the control motor is excited.

The intermediate adjustment path or intermediate adjustment range between $s_1$ and $s_2$ is required in order to permit the parameter-dependent regulation of the operating medium via the control line 3 to come into effect in a suitable manner. During the regulated phase, the control section 37, 37' is rotated further in the clockwise direction, past the position $s_2$, so that the control edge 48, cooperating with the limiting face 42 of the throttle opening 41, opens up a second throttle cross section 49, as is shown in FIG. 5. In the illustration provided by FIG. 6, the control section 37, 37' has been rotated by the control motor to such an extent that it assumes a postion $s_{max}$, in which it opens the throttle opening 41 completely, so that the maximum air quantity $Q_{max}$ can flow via the throttle opening 41, which in this position of the control section embodies the second throttle cross section 49. What was described in connection with FIGS. 1–7 applies in like manner to the control section 37'.

In the further exemplary embodiment of an apparatus 4 shown in FIG. 8, a throttle device 55 is axially displaceable counter to the force of a spring element 57 by means of an electromagnetic control motor 56 of known design. The control line 3 having a throttle seat 58 discharges into the apparatus 4. The throttle device 55 has a throttling part 59 and an actuation part 60. The control motor 56 engages the actuation part 60, which may simultaneously act as the armature for the control motor 56. The throttling part 59 is composed of a throttle step 62 and a stop shoulder 63. The throttle step 62 has a diameter which almost equals the diameter of the control line 3, so that the throttle step 62 is capable of protruding into the control line 3. When the control motor 56 is not excited, the throttling part 59 is displaced by the spring element 57, via the actuation part 60, in the direction of the throttle seat 58 in such a manner that the stop shoulder 63 comes to rest on the throttle seat 58, which simultaneously acts as a stop, and the throttle step 62 protrudes into the control line 3. This position is assumed by the throttling part 59 in its position of rest or in the event of the failure of the supply of current to the control motor 56. A connecting line 64 which is open toward the control line 3 upstream of the throttle seat 58 leads through the throttling part 59 to the circumference of the actuation part 60 downstream of the throttle seat 58. The mouth or mouths of the connecting line 64 where it discharges at the circumference of the actuation part 60 is or are formed by a first throttle cross section 65, which when the stop shoulder 63 is resting on the throttle seat 58 is completely opened. In this position, as already described for the foregoing exemplary embodiment, an emergency-operation quantity $Q_N$ as shown in FIG. 7 flows through the first throttle cross section 65. Upon the excitation of the control motor 56, the control motor 56 will at first, via the actuation part 60, displace the throttling part 59 far enough that it will traverse the adjustment path $s_1$, until the first throttle cross section 65 reaches the vicinity of a sealing body 66 attached to the housing; this sealing body 66 covers the first throttle cross section 65 and prevents any flow via the connecting line 64. In this position, until the end of the intermediate adjustment range or intermediate adjustment path at $s_2$, only a leakage flow quantity $Q_1$ which is kept as small as possible but depends on apparatus-assembly requirements is possible. Only with an adjustment movement beyond the position $s_2$ is the throttle step 62 retracted from the cross section of the control line 3, thereby forming a second throttle cross section 67 in cooperation with the throttle seat 58, as shown in FIG. 9.

Figure 9:
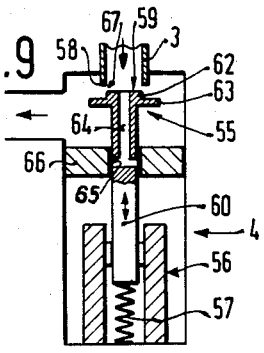
FIG. 9 is an illustration of the apparatus of FIG. 8, shown in the open position.

The mode of operation of the exemplary embodiment shown in FIGS. 1–6 is thus identical to that for the apparatus according to FIGS. 8 and 9, the difference being solely that in the first exemplary embodiment according to FIGS. 1–6 the throttle device 5 executes a rotational movement, while in the second exemplary embodiment according to FIGS. 8 and 9 the throttle device 55 executes an axial movement.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A method for controlling at least one throttle cross section in a control line carrying an operating medium for an internal combustion engine by means of an electric control motor which actuates a throttle device counter to a spring element related to said throttle device in order to control a size of a throttle cross section which controls flow of said operating medium, wherein said throttle device, is movable by a spring element into a position in which it rests on a stop and a first throttle cross section is opened when said control motor is unexcited, and upon excitation of the control motor, the throttle device is actuatable in such a manner that said first throttle cross section is closed and after an intermediate adjustment path ($s_1$–$s_2$), during which said first throttle cross section is closed, during further movement of said throttle device a second throttle cross section is opened while said first throttle cross section continues to remain closed.

2. A method as defined by claim 1, in which openings of said first and second throttle cross sections are controllable by means of the throttle device.

3. An apparatus for controlling at least one throttle cross section in a control line carrying an operating medium for an internal combustion engine, comprising an electric control motor, a control spring, a throttle device actuatable by said electric control motor counter to said spring element in order to influence an opening size of said at least one throttle cross section, a shaft in said apparatus, a control section in the form of a circular segment rotatably supported about said shaft relative to a control opening which intersects said control line and which serves as a throttle device, said control section being rotatable by means of the spring element into a position in which it rests against a stop and opens a first throttle cross section connecting the control line upstream of the control section with the control opening when the control motor is not excited, and said control section is rotatable upon the excitation of said control motor such that within an intermediate adjustment range ($s_1$–$s_2$) said control section closes each throttle cross section and subsequently thereto opens only a second throttle cross section, said second throttle cross section being formed in the intersection of the control line and the control opening.

4. An apparatus as defined by claim 3, wherein said first throttle cross section is likewise formed in the intersection of the control line and the control opening.

5. An apparatus as defined by claim 3, in which said first and second throttle cross sections are each controllable by one respective control edge of said circular-segmental control section.

6. An apparatus as defined by claim 4, in which said first and second throttle cross sections are each controllable by one respective control edge of said circular-segmental control section.

7. An apparatus as defined by claim 3, wherein said first throttle cross section is formed by an opening in a wall of said apparatus between the control line and the control opening.

8. An apparatus as defined by claim 7, wherein said first and second throttle cross sections are each controllable by one respective control edge of the circular-segmental control section.

9. An apparatus for controlling at least one throttle cross section in a control line carrying an operating medium for an internal combustion engine, which comprises an electric control motor, a control spring element, a throttle device actuatable by said electric control motor counter to a control spring element in order to influence an opening size of said at least one throttle cross section, a shaft in said apparatus, a throttle device supported in an axially displaceable manner and displaced by means of said control spring element to rest with a throttling part against a stop when the control motor is not excited, whereupon a first throttle cross section leading from the control line from upstream to downstream of the throttling part is opened, and upon excitation of the control motor said throttle device is displaced in such a manner that within an intermediate adjustment range ($s_1$–$s_2$) said throttle cross section is closed, and subsequently movement of said throttle device by means of a throttling part opens only a second throttle cross section, which second throttle cross section connects the control line upstream of the throttling part relative to the control line downstream therefrom.

10. An apparatus as defined by claim 9, in which a throttle seat to which the control line is carried serves as the stop.

11. An apparatus as defined by claim 10, in which said throttle device is composed of said throttling part and an actuation part engaging said throttling part, and said first throttle cross section is embodied in a mouth of a connecting line, which at the throttling part and upstream of the throttle seat is open toward the control line and at the circumference of the actuation part downstream of the throttle seat has a mouth opening.

12. An apparatus as defined by claim 11, in which a mouth opening of the connecting line serving as the first throttle cross section is open toward the control line downstream of the throttle seat when the throttling part is resting on the throttle seat.

13. An apparatus as defined by claim 11, in which upon excitation of the control motor, the actuation part of said throttle device is displaced into a position in which a sealing body attached to the housing closes the first throttle cross section.

14. An apparatus as defined by claim 10, in which said throttling part of said throttle device has a stop shoulder cooperating with the throttle seat and a throttle step pointing upstream, which when the control motor is not excited and when the control motor is excited within the intermediate adjustment range ($s_1$–$s_2$) protrudes into the control line and prevents a flow of operating medium to the throttle seat, while upon further excitation of the control motor a second throttle cross section is opened between the throttle seat and the throttle step.

* * * * *